United States Patent [19]

Yasutake

[11] Patent Number: 4,567,865

[45] Date of Patent: Feb. 4, 1986

[54] CRANKCASE FOR AN INTERNAL COMBUSTION ENGINE

[75] Inventor: Kosuke Yasutake, Saitama, Japan

[73] Assignee: Honda Giken Kogyo Kabushiki Kaisha, Tokyo, Japan

[21] Appl. No.: 624,606

[22] Filed: Jun. 26, 1984

[30] Foreign Application Priority Data

Jun. 27, 1983 [JP] Japan ..... 58-115466

[51] Int. Cl.[4] ..... F02F 7/00

[52] U.S. Cl. ..... 123/195 R; 123/195 AC; 123/195 H

[58] Field of Search ..... 123/195 R, 195 S, 195 AC, 123/195 H

[56] References Cited

U.S. PATENT DOCUMENTS

| | | | |
|---|---|---|---|
| 3,059,623 | 10/1962 | Booth et al. | 123/195 R |
| 3,109,416 | 11/1963 | Rose et al. | 123/195 AC |
| 4,318,375 | 3/1982 | Sauer | 123/195 R |
| 4,393,822 | 7/1983 | Obermayer et al. | 123/195 R |
| 4,453,509 | 6/1984 | Hayashi | 123/195 R |

FOREIGN PATENT DOCUMENTS

| | | | |
|---|---|---|---|
| 1229371 | 4/1971 | United Kingdom | 123/195 R |

*Primary Examiner*—Craig R. Feinberg

*Attorney, Agent, or Firm*—Lyon & Lyon

[57] ABSTRACT

A crankcase having a unitary transverse bearing wall through which a crankshaft is mounted. The bearing wall includes blind holes extending passed the bearing hole on either side thereof for receipt of high strength bolts extending therein.

4 Claims, 3 Drawing Figures

CRANKCASE FOR AN INTERNAL COMBUSTION ENGINE

BACKGROUND OF THE INVENTION

The field of the present invention is structural designs for internal combustion engine crankcases.

Crankcases for internal combustion engines typically have been formed as part of the engine block with the underside of the block machined to receive bearings supporting the crankcase of the engine. The bearings are then held in place by bearing caps rigidly bolted to the underside of the engine block. Certain designs have contemplated the employment of a lower case as a means for supporting the bearings against the underside of the engine block. In such an instance, bolts extend upwardly through the lower case and into the engine block for rigidly affixing the lower case in position. With such a design, this rigid fixing of the lower case with the engine block results in a secure mounting for the main bearings in bearing seats defined between the block and the lower case.

In relatively small engines, such as small motorcycle engines, designs have been developed which employ a crankcase construction divided at a plane perpendicular to the axis of the crankshaft. Thus, the bearing walls supporting the crankshaft are unitary in construction. Seats for the bearings are created in such bearing walls. With such crankcase designs, significant loading on the crankshaft of such engines must be resisted by the unitary bearing wall as a result of the inertial forces associated with the reciprocal motion of the piston or pistons. Such loading is specifically imposed on the bearing walls of the crankcase about the crankshaft in a direction substantially parallel to the centerline of the cylinder or cylinders. As such, the loading is at a maximum through a cross-section of each bearing wall perpendicular to the line of force which is substantially parallel to the centerline of the cylinder or cylinders.

An obvious solution to the problem of excessive load in the aforementioned area in crankcases split along a plane perpendicular to the crankshaft is to increase the wall thickness of the crankcase in the areas about the bearing holes experiencing excessive stress. However, such a solution is not always practical. With existing crankcase designs, it may be impossible to increase the wall thickness surrounding the bearing hole because of interference with other components. Even in new designs, little room is often available for increased bearing length without like increases in engine length. Such solutions are near impossible with existing engines needing reinforcement.

Another obvious solution is to employ high strength material in fabrication of the crankcase. However, lighter engines are preferred, preferably in such applications as motorcycles and the like. As a result, die cast aluminum has become widely used for the fabrication of crankcases. Substantial weight advantage would be lost through employment of cast iron or the like.

SUMMARY OF THE INVENTION

The present invention pertains to the increase in rigidity and strength of a crankcase with unitary bearing walls for accommodating high bearing loads transmitted by the crankshaft of an internal combustion engine. Through the present invention, increased wall thickness of the crankcase about bearing holes is unnecessary to accommodate increased or excessive load. Additionally, die cast aluminum crankcases may be strengthened without significant weight increase. The present invention also finds great utility in increasing the strength of existing engines and engine designs.

To accomplish the foregoing, high strength bolts are arranged about bearing holes in a crankshaft bearing wall of an engine. The holes are blind and threaded through a portion of their length to receive the high strength bolts which may then be placed in tension to reduce the stress loads in the crankshaft bearing wall about the bearing hole. The bolts add minimally to the weight of the crankcase, do not require increased wall thickness and do not create technical casting difficulties.

Thus, an improved crankcase structure may be provided to accommodate excessive bearing loads imposed by the crankshaft in a crankcase without significant design changes, increased weight or increased design complexity. Other objects and advantages will appear hereinafter.

DETAILED DESCRIPTION OF THE PREFERRED EMBODIMENT

Figure 1:
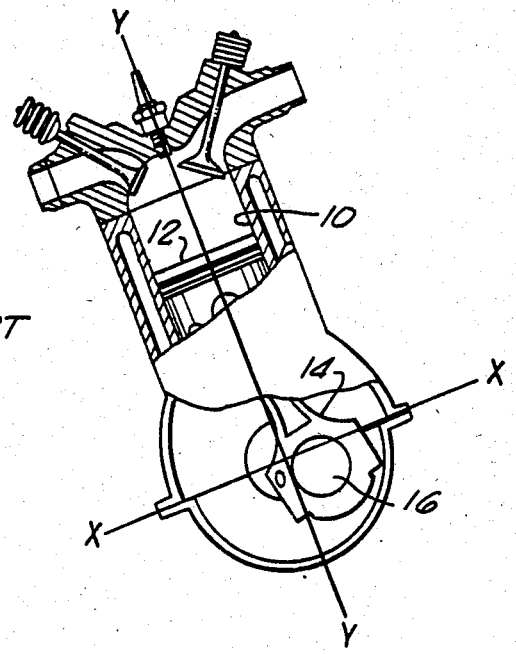
FIG. 1. PRIOR ART
FIG. 1 is an end view of a conventional internal combustion engine with portions broken away for clarity.

Turning in detail to the drawings, an internal combustion engine is illustrated in FIG. 1. The internal combustion engine includes a cylinder 10 within which a piston 12 reciprocates. The piston 12 is connected by means of a connecting rod 14 to a crankshaft 16. The crankshaft 16 is positioned within and rotatably mounted to a crankcase.

Substantial forces experienced by the crankcase in supporting the crankshaft 16 resulting from the reciprocation of the piston 12 generally lie parallel to the axial centerline of the cylinder 10 identified as line Y—Y. These forces must be sustained across a cross section defined by plane X—X about the mounted crankshaft 16.

Figure 2:
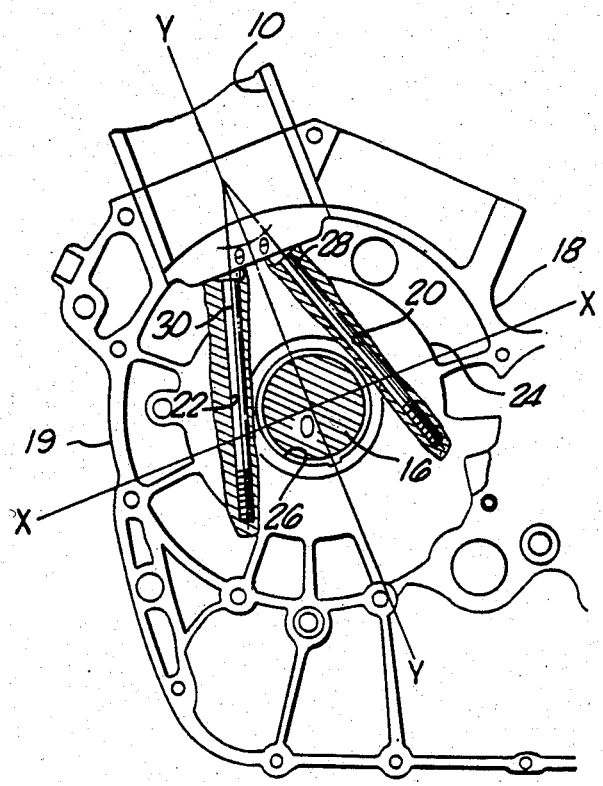
FIG. 2 is a detailed side view of a section of a crankcase of the present invention with portions broken away for clarity.
Figure 3:
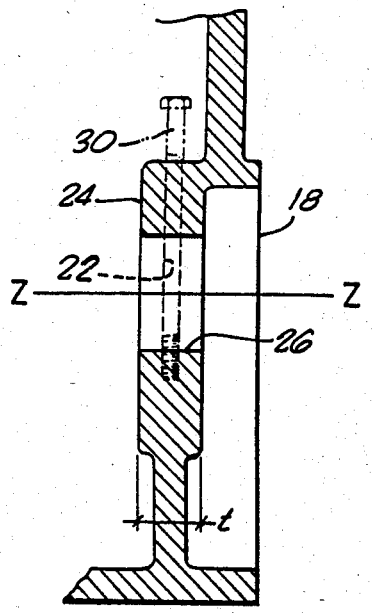
FIG. 3 is a cross sectional view taken along line Y—Y of FIG. 2.

Looking then to the specific structure of the preferred embodiment illustrated in FIGS. 2 and 3, one section 18 of the crankcase is illustrated of the type which is split at a plane perpendicular to the axis of the crankshaft. The mating surface 19 of the section 18 is illustrated in full view in FIG. 2. Blind holes 20 and 22, holes not extending fully through the crankcase, are shown to extend downwardly from an area about the bottom end of the cylinder 10. These holes 20 and 22 extend past either side of the crankshaft 16 within a transversely extending crankshaft bearing wall 24 shown to be one piece unitary construction. A bearing hole 26 within the bearing wall 24 receives the crankshaft 16. The bearing hole 26 defines the location of the axial centerline of the crankshaft 16 at point 0 as seen in FIG. 2 and along line Z—Z as seen in FIG. 3.

Located within the blind holes 20 and 22 are bolts 28 and 30 respectively. The blind holes 20 and 22 are threaded, at least at their lower end. Bolts 28 and 30 are also threaded to properly engage the blind holes 20 and 22. Tension may be imposed on the bolts 28 and 30 through sufficient tightening to create a preloading of compression within the bearing wall 24 which may resist the forces imposed thereon. The bolts 28 and 30 are preferably of high tensile strength steel or other similar material exhibiting substantially greater tensile strength than the die cast aluminum crankcase 18.

The bearing wall 24 is illustrated in FIG. 3 to have an increased thickness t about the bearing hole 26. This increased thickness supports the proper length bearing and adds strength to the case 18. The axial location of the bearing wall 24 is determined by the available area along the crankshaft for location of bearing support.

The orientation of the blind holes 20 and 22 and the bolts 28 and 30 located therein is designed to specifically resist the inertia forces of the reciprocating piston 12 and associated connecting rod 14. To this end, the blind holes 20 and 22 are located symmetrically about a line lying in a centerline plane of the engine which includes the centerline of the crankshaft 16 and the axial centerline of the cylinder 10. In this way, the resisting forces act as though they pass directly through the axial centerline of the crankshaft 16. The preferred embodiment illustrates diverging blind holes 20 and 22 in the direction of the ends of the holes as can best be seen in FIG. 2. Thus, angles theta are generated between the centerline therebetween and the centerline of each separate hole. It is desirable to have the angle theta equal to zero. However, accommodation for tapping of the blind holes 20 and 22 and placement of the bolts 28 and 30 requires, in the preferred embodiment, that theta is greater than zero. Indeed, the angle theta may be as much as 45° where necessary. The location of the bolts vis-a-vis the thickness of the bearing wall 24 for proper strength should be such that the centerline of each blind hole 20 and 22 should be within ±10 millimeters of the centerline of the bearing wall 24. The blind holes 20 and 22 may extend as much as ±20° from the center plane of the bearing wall 24.

Thus, an improved bearing wall structure of a crankcase is disclosed. The structure can enhance the rigidity of the crankcase with no increase in wall thickness. A substantial degree of freedom is provided for achieving rigidity including selection of the number of bolts employed, the material and the diameter of the bolts. In spite of the added structural strength, only minimal weight increases are incurred. While embodiments and applications of this invention have been shown and described, it would be apparent to those skilled in the art that many more modifications are possible without departing from the inventive conepts herein. The invention, therefore, is not to be restricted except in the spirit of the appended claims.

What is claimed is:

1. A crankcase for an internal combustion engine having a crankshaft and at least one cylinder with an axial centerline intersecting an axial centerline of the crankshaft, the crankcase being split at a plane perpendicular to the axis of the crankshaft, comprising a crankshaft bearing wall having upper and lower portions on opposite sides of a plane perpendicular to said cylinder axial centerline through said axis of the crankshaft of unitary construction extending transversely of the crankshaft and including a bearing hole therethrough having a predetermined diameter for receipt of the crankshaft;

blind holes extending into said crankshaft bearing wall into both of said upper and lower portions adjacent and past either side of said bearing hole, being symmetrically disposed about a centerline intersecting the axial centerline of the crankshaft which extends parallel to the centerline of the cylinder, said blind holes on either side of said bearing hole, respectively, diverging one from another toward bottom ends thereof a distance from less than the diameter to a distance greater than the diameter of the bearing hole and being threaded in said lower portion at least at the bottom ends thereof;

threaded bolts disposed in said blind holes extending from a top of said unitary bearing wall to the threaded end portions of said blind holes and being screwed together with said holes with said bolts in tension.

2. The crankcase of claim 1 wherein said bolts are of a material having a substantially higher tensile strength than the material of said crankcase bearing wall.

3. The crankcase of claim 1 wherein there are two said blind holes.

4. The crankcase of claim 1 wherein said blind holes extend into said crankshaft bearing wall from the inside of the engine.

* * * * *